United States Patent [19]

Smith

[11] Patent Number: 5,020,727

[45] Date of Patent: Jun. 4, 1991

[54] SPRAY NOZZLE TRIGGER OPERATED SUPPLY VALVE

[75] Inventor: James E. Smith, St. Petersburg, Fla.

[73] Assignee: Graves Spray Supply, Inc., Clearwater, Fla.

[21] Appl. No.: 526,652

[22] Filed: May 22, 1990

[51] Int. Cl.[5] ..... B05B 9/01

[52] U.S. Cl. ..... 239/526; 239/569; 137/242; 251/282; 251/343; 251/360

[58] Field of Search ..... 239/525, 526, 570, 569; 137/242; 251/282, 343, 347, 360

[56] References Cited

U.S. PATENT DOCUMENTS

| | | | |
|---|---|---|---|
| 801,886 | 10/1905 | Leidecker | 137/242 |
| 917,071 | 4/1909 | Huestis | 251/347 |
| 1,199,894 | 10/1916 | Hurley | 137/242 |
| 1,654,451 | 12/1927 | Blust | 137/242 |
| 1,833,748 | 11/1931 | Hellstrom | 239/570 |
| 2,657,895 | 11/1953 | Huber et al. | 251/347 |
| 3,288,379 | 11/1966 | Croft et al. . | |
| 3,317,141 | 5/1967 | Mann | 239/590.3 |
| 3,358,928 | 12/1967 | Melendy . | |
| 3,380,705 | 4/1968 | Enssle | 239/526 |
| 3,608,576 | 9/1971 | Wilhelm | 137/242 |
| 4,128,209 | 12/1978 | Johnson . | |
| 4,166,579 | 9/1979 | Beise et al. | 239/526 |
| 4,403,741 | 9/1983 | Moriya et al. . | |
| 4,470,549 | 9/1984 | McMillan et al. . | |

*Primary Examiner*—Andres Kashnikow
*Assistant Examiner*—Karen B. Merritt
*Attorney, Agent, or Firm*—Barnes & Thornburg

[57] ABSTRACT

A spray gun having a trigger lever operated supply valve which includes a reciprocating hollow valve sleeve and a free floating spherical valve element to close the hollow in the reciprocating valve sleeve when the valve sleeve is in its closed position. The free floating spherical valve element and the valve sleeve are located in a chamber which has at least two exit ports spaced from one another at a distance in excess of the diameter of the spherical valve element. End areas of the valve sleeve are equal and subject to the pressure of the material flowing through the valve in its open position to provide a balanced force on the valve sleeve when the valve is open and to help a bias spring to hold the valve in the closed position.

20 Claims, 1 Drawing Sheet

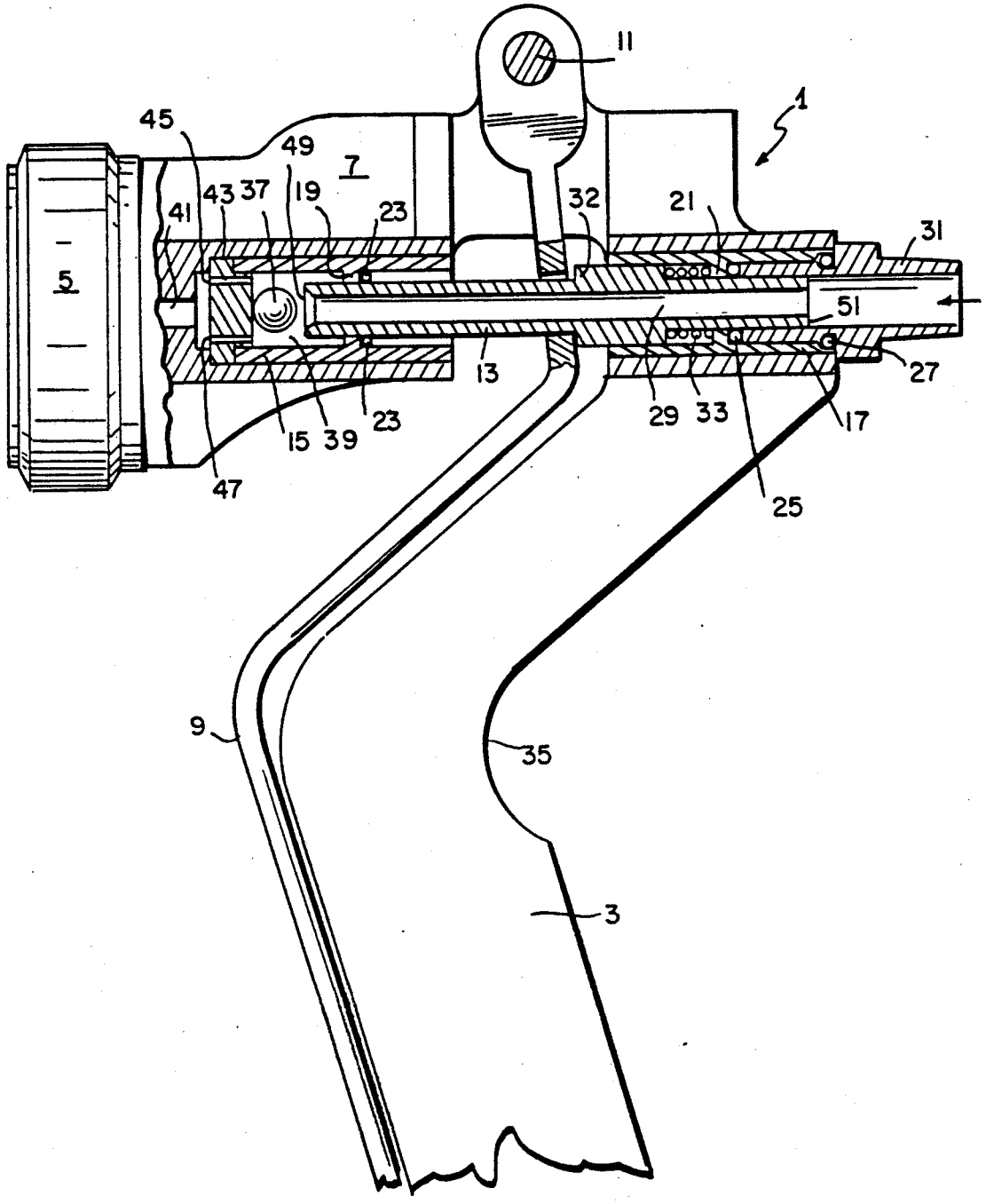
11
1
45
49
7
43
37
19
23
32
21
31
41
5
51
13
27
29
33
17
15
39
23
47
25
9
35
3

SPRAY NOZZLE TRIGGER OPERATED SUPPLY VALVE

BACKGROUND OF THE INVENTION

The present invention generally relates to fluid spray guns and more particularly to supply valves for compact fluid spray guns used for paint spraying, fiberglass spraying and plasticizer spraying, etc.

The above types of spray guns normally contain a handle and a trigger lever(s) located adjacent the handle so that the operator can easily operate the gun. One trigger lever is used for operating a supply valve used to control flow of fluids e.g. paint supply(s), catalyst, resin, etc. and air for mixing, shaping, etc. It is possible to utilize one trigger element which in its initial arc of movement operates the supply valve and in its latter arc of movement operates the various metering systems that control the aforementioned flows of materials.

The prior art supply valve in spray guns have generally used spool or needle valves. These valves were biased in the closed direction by springs and the fluid flow of the open valve worked against the spring. This required large springs and large actuation forces to open the valves. Also with these valves, the fluid was introduced radially and exited axially. This requires additional space in the gun for the transmission of fluid from the inlets to the outlet of the valve.

Past attempts to provide supply valves have had unsatisfactory results due to among other things, their length, the number of parts, sealing systems, material flow resistance causing hand fatigue of the operator in operating the supply valve and keeping the triggering lever in position, etc.

It is an object of this invention to overcome the above unsatisfactory results by providing a compact spray gun and supply valve system which has only a few parts.

An object is to provide a supply valve which is compact in length.

It is a further object to utilize the pressure of the material flowing through the spray gun to assist a spring to bias the shut-off valve to its closed position while also providing no resistance to the actuating trigger when the shut-off valve is in its open flow permitting position.

The apparatus includes a first valving element comprising a reciprocating valving sleeve with a passageway therethrough. Ends of the sleeve have similar cross-sectional areas and are subject to the pressure of the material(s) flowing through the valve when the valve is opened. This equal area causes the sleeve to be fluidically balanced when the supply valve is open. A spring biases the reciprocating valving sleeve to its closed position and the pressure upstream of the sleeve applies a force to an upstream end of the reciprocating valving sleeve to assist the spring. The spring surrounds the reciprocating valving sleeve and is located in a chamber sealed from egress of the material flowing through the reciprocating valving sleeve.

Downstream of the reciprocating valving sleeve is a valving chamber containing a spherical, free floating second valving element which cooperates with the downstream side of the hollow passageway of the reciprocating valving sleeve. When the gun trigger is released, the spring bias forces the reciprocating valving sleeve to abut the spherical valving element to seal off flow of spray gun material through the passageway.

The pressure of this material helps hold the reciprocating valving sleeve against the spherical valving element.

When the operator applies a force to the trigger lever, it moves the reciprocating valving sleeve and opens the valve in opposition to the force of the spring. As the reciprocating valving sleeve moves away from the spherical valving element, material beings to flow through the passageway in the reciprocating valving sleeve and through a valving chamber so that the reciprocating valving sleeve has its downstream end acted on by the pressure of the material flowing through the spray gun. The downstream pressure acts in opposition to the upstream pressure of the material to allow the reciprocating valving sleeve to be in a pressure balanced condition as concerns the pressure of the material flow. This admits of a smoother actuation of the supply valve and reduces the hand pressure of the operator in holding the valve open. Thus hand fatigue of the operator is reduced.

The downstream valving chamber housing the free floating spherical valving element can be cylindrical and has one end open to the reciprocating valving sleeve and an opposite end having at least two outlets therein.

The outlets are spaced at the same radial distance from the flow axis of the supply valve. The radial distance is at least equal to, or greater than the radius of the free floating spherical valving element. This causes the material flow to divide as it exits the outlets of the passage in the reciprocating valving sleeve and flows over the spherical valving element to help keep it centered on the axis of the reciprocating valving sleeve. The spherical element is free floating so it can rotate to provide changing valve surfaces for the supply valve thus improving its useful life. The spherical element also is able to bounce around in the cylindrical valve chamber to assist in cleaning the supply valve.

The valving end of the reciprocating valving sleeve preferably has a rounded configuration to match the configuration of the spherical valving element. Alternatively the valving end could be chamfered. Even a flat perpendicular edge could be used.

Other objects, advantages and novel features of the present invention will become apparent from the following detailed description of the invention when considered in conjunction with the accompanying drawings.

BRIEF DESCRIPTION OF THE DRAWING

The FIGURE shows a schematic representation of a spray gun showing the gun handle, trigger, nozzle and supply valve assembly in an open flow position.

DETAILED DESCRIPTION OF THE DRAWING

The FIGURE shows a spray gun assembly 1 with a handle 3 and spray gun nozzle 5. The spray gun assembly 1 includes a body portion 7 to which a trigger lever 9 is pivoted at pivot mounting 11. A first valving element comprises a hollow valving sleeve 13, reciprocatingly mounted on bearing lands 19 and 21 on bearing elements 15 and 17 located in bores of the housing 7. O-ring seals 23, 25 and 27 are provided to ensure no leakage of material flowing through the passageway 29 of the reciprocating valving sleeve 13. Seals 25 and 27 act between the bearing element 17 and an inlet fitting 31 for connection to a pressurized source (not shown) of flow material for the spray gun assembly 1.

A compressed bias spring 33 is located around the reciprocating valving sleeve 13 and between a flange thereon and the land 21 of the bearing element 17. The bias spring 33 applies a closing force to urge the reciprocating valving sleeve 13 to a closed (leftward in the FIGURE) position. Trigger lever 9 abuts a flange 32 on the reciprocating valving sleeve when the lever 9 is rotated counter-clockwise by a hand of the operator (not shown) as the hand grips the handle 3 of the spraying assembly 1. A notch area 35 is located on the handle 3 to accommodate the space between the thumb and index finger (both not shown) of the operator.

A free floating spherical valving element 37 is located in a downstream cylindrical chamber 39. The chamber 39 has an inlet end where the reciprocating valving sleeve 13 passes the bearing land 19 and an exit end 41 leading to the spray gun nozzle 5. An end plate 43 is located in the downstream cylindrical chamber to define an end thereof an is equipped with at least two spaced exit ports 45 and 47. The ports are arranged at an equal distance from the axial center line of the passageway 29. When two exit ports are used they are diametrically opposed to one another on opposite sides of the center line of the passageway 29. The distance between these ports 45, 47 is at least equal to, or greater than, the diameter of the spherical valve element 37.

When an operator releases the trigger lever 9, the spring 21 will move the reciprocating valving sleeve 13 (to the left as shown) so that its seat surface 49 cooperates with the spherical valving element 37 to stop and seal the flow of material through the passageway 29 of the reciprocating valving sleeve 13. The seat surface 49 is configured complimentary to the spherical valving element 37 or chamfered to not only form a good seal with the sphere 37, but to also align or register the sphere 37 with the seat surface 49 as the reciprocating valving sleeve 13 moves to the left as shown in the FIGURE. When the spherical valving element 37 is seated on seat surface 49, the pressure of material at the inlet fitting 31 acts on the end surface 51 of the reciprocating valving sleeve 13 to hold it against the spherical valve element 37.

When trigger lever 9 is grasped and rotated counter-clockwise about pivot 11, it abuts flange 32 and forces the reciprocating valving sleeve 13 to the open position (toward the right as shown) in opposition to the bias spring 33 and the pressure force of the material on end surface 51 of the reciprocating valving sleeve 13. As the reciprocating valving sleeve opens, pressure of the material in the downstream cylindrical chamber 39 will act on seat surface 49 of the reciprocating valving sleeve 13 to balance the pressure on the upstream end 51 thereof. This reduces the pressure necessary to hold open the valve and allows the reciprocating valve sleeve to be fluid pressure balanced in its open condition.

Having the exit ports 45, 47 spaced at a distance equal to, or greater than, the diameter of the free floating spherical valving element 47 allows the material to flow completely around the spherical valving element 47. This maintains the spherical valving element 47 centered on the axis of the passageway 29 of the reciprocating valving sleeve 13 so that it will seat on the seat surface 19 when the valve is closed. This flow of material around the spherical valving element and its hitting against the end plate 43 cleans the surface of the sphere 47 and provides a changing seating surface for the reciprocating valving sleeve 13. Shaking the gun 1 will cause the sphere 37 to bounce around in chamber 39 thereby cleaning the walls and sphere. Any motion of the sphere (rotational or bouncing around) will aid mixing of the material flow.

While only two exit ports 45 and 47 are shown, the end plate 43 can have many ports preferably spread around in a circle.

Also where spring 33 has been shown as the bias for trigger lever 9, an auxiliary spring (between the lever and housing 7 of handle 3) could be provided so as to allow for downsizing of the spring 33.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A spray gun having a supply valve connecting an inlet with a spray nozzle and a trigger at a spray gun handle for operating said valve, comprising:

a valve chamber having an inlet and an outlet;

a first valving means which is shiftable in said chamber between an open position to allow flow of material from the inlet to the outlet and to a closed position precluding flow of material from said inlet to said outlet;

a second valving means free floating in said chamber when said first valving means is in its open position and engaged and positioned by said first valving means when said first valving means is in its closed position.

2. The spray gun of claim 1 wherein the second valving means is spherical in shape so as to provide a multitude of engaging outer surface areas for said first valving means.

3. The spray gun of claim 2 wherein the first valving means includes a first and second surface exposed to pressure forces of the material flowing through the spray gun when the first valving means is in its open position to pressure balance said first valving means in said open position; and wherein pressure on only said first surface of the material applies a force for holding the first valving means against the second valving means when the first means in its closed position.

4. The spray gun of claim 2 wherein the first valving means has a passageway with an upstream end connected to a source of the pressure material and a downstream end which forms said chamber inlet; and wherein said downstream end cooperates to form a seal with the second valving means.

5. The spray gun of claim 1 wherein the first valving means includes a first and second surface exposed to pressure forces of the material flowing through the spray gun when the first valving means is in its open position to pressure balance said first valving means in said open position; and wherein pressure on only said first surface of the material applies a force for holding the first valve means against the second valving means when the first means is in its close position.

6. The spray gun of claim 5 wherein the first valving means has a passageway with an upstream end connected to a source of the pressure material and a downstream end which forms said chamber inlet; and wherein said downstream end cooperates to form a seal with the second valving means.

7. The spray gun of claim 5 wherein a bias means is located in a second chamber that surrounds the first valving means for biasing the first valving means to its closed position; and wherein said bias means chamber is sealed from the flow of material through the spray nozzle.

8. The spray gun of claim 5 wherein said chamber has a lateral dimension greater than said second valving means so as to allow the second valving means to freely float therein;

wherein the chamber has at least two outlet ports on an end wall thereof separated by a distance greater than the diameter of the second valving means; and wherein the first valving means is located on an end wall of the cylindrical chamber which is opposite to said outlet port end wall.

9. The spray gun of claim 1 wherein the first valving means has a passageway with an upstream end connected to a source of the pressure material and a downstream end which forms said chamber inlet; and wherein said downstream end cooperates to form a seal with the second valving means.

10. The spray gun of claim 9 wherein a bias means is located in a second chamber that surrounds the first valving means for biasing the first valving means to its closed position; and wherein said bias means chamber is sealed from the flow of material through the spray nozzle.

11. The spray gun of claim 9 wherein said chamber has a lateral dimension greater than said second valving means so as to allow the second valving means to freely float therein;

wherein the chamber has at least two outlet ports on an end wall thereof separated by a distance greater than the diameter of the second valving means; and wherein the first valving means is located on and end wall of the cylindrical chamber which is opposite to said outlet port end wall.

12. The spray gun of claim 1 wherein a bias means is located in a second chamber that surrounds the first valving means for biasing the first valving means to its closed position; and wherein said bias means chamber is sealed from the flow of material through the spray nozzle.

13. The spray gun of claim 1 wherein said chamber has a lateral dimension greater than said second valving means so as to allow the second valving means to freely float therein;

wherein the chamber has at least two outlet ports on an end wall thereof separated by a distance greater than the diameter of the second valving means; and wherein the first valving means is located on an end wall of the cylindrical chamber which is opposite to said outlet port end wall.

14. A spray gun nozzle having a valve connecting an inlet with a spray nozzle and a trigger at a spray gun handle for operating said valve, said valve comprising:

a valving chamber connecting an outlet end of a passageway in a reciprocating valving sleeve with said spray nozzle;

a free floating valving means located in said chamber;

wherein said outlet end of said passageway in said reciprocating valving sleeve co-acts with said free floating valving means to control flow of material from said outlet end and around an outer surface of the free floating valve means to said spray nozzle when said valve is in an open position; and wherein said free floating valving means provides a multitude of surfaces for the co-action with said outlet end of said passageway when said valve is in a closed position.

15. A spray gun nozzle according to claim 14 wherein the valving chamber has a plurality of spaced apart exit ports for directing material from said valving chamber to said spray nozzle for assisting material flowing through the valve to flow around the outer surface of the free floating valve means.

16. A spray nozzle according to claim 15 wherein a distance between two of the exit ports is greater than the exit end of the passageway of the reciprocating valving means.

17. A spray nozzle according to claim 16 wherein a bias means is provided to urge the outlet end of the passageway of the reciprocating valving means against the free floating valving means; and wherein said bias means is sealed from the flow of material through the valve.

18. A spray nozzle according to claim 15 wherein a distance between two of the exit parts is greater than a diameter of free floating valving means.

19. A spray nozzle according to claim 15 wherein a bias means is provided to urge the outlet end of the passageway of the reciprocating valving means against the free floating valving means; and wherein said bias means is sealed from the flow of material through the valve.

20. A spray nozzle according to claim 14 wherein a bias means is provided to urge the outlet end of the passageway of the reciprocating valving means against the free floating valving means; and wherein said bias means is sealed from the flow of material through the valve.

* * * * *